United States Patent [19]

Hutzenlaub et al.

[11] Patent Number: 5,025,998

[45] Date of Patent: Jun. 25, 1991

[54] UNWINDING CARRIAGE FOR ROLLS OF STRIP MATERIALS

[75] Inventors: Armin Hutzenlaub, Wiehl; Reinhard Dick, Nümbrecht, both of Fed. Rep. of Germany

[73] Assignee: Kampf GmbH & Co. Maschinenfabrik, Wiehl, Fed. Rep. of Germany

[21] Appl. No.: 487,496

[22] Filed: Mar. 1, 1990

[30] Foreign Application Priority Data

Mar. 1, 1989 [DE] Fed. Rep. of Germany ..... 3906506

[51] Int. Cl.[5] ..... B65H 16/06; B65H 16/10

[52] U.S. Cl. ..... 242/55; 242/58.6

[58] Field of Search ..... 242/55, 54 R, 58.6, 242/68.4, 79, 129.51

[56] References Cited

U.S. PATENT DOCUMENTS

| | | | |
|---|---|---|---|
| 3,052,422 | 9/1962 | Moser et al. | 242/68.4 |
| 3,057,571 | 10/1962 | Aaron et al. | 242/58.6 |
| 3,175,779 | 3/1965 | Grobman et al. | 242/58.6 |
| 4,458,851 | 7/1984 | Tokuno e al. | 242/55 |
| 4,706,905 | 11/1987 | Torres | 242/58.6 X |
| 4,895,314 | 1/1990 | Thievessen | 242/68.4 X |

*Primary Examiner*—John M. Jillions

*Attorney, Agent, or Firm*—Herbert Dubno

[57] ABSTRACT

A torsion stiff frame formed by a swingable plate, a bracing bar and a hollow member or tube is mounted upon a torsion stiff frame formed by support plates and a round bar defining the pivot axis. The roll carrying arms are engaged with the central tube and braced upon the bracing bar but are shiftable by a threaded spindle driven by a motor externally of a support plate via a shaft passing through an arcuate slot thereon. A shaft also driven by a motor mounted on the support plate coaxial with the round traverse is used to drive the rolls.

15 Claims, 2 Drawing Sheets

UNWINDING CARRIAGE FOR ROLLS OF STRIP MATERIALS

CROSS REFERENCE TO RELATED APPLICATION

This application is related to the commonly assigned copending application Ser. No. 07/477,561 filed Feb. 9, 1990.

FIELD OF THE INVENTION

Our present invention relates to an unwinding or unrolling carriage for band-like strip material, e.g. webs of paper, fabric, metal or the like, in which the roll is engaged between a pair of roll-engaging gripper members on arms swingable to permit the roll to be raised or lowered. The carriage can be movable on rails or the like to align the edges of a roll engaged by the arm with the previously delivered strip material for splicing.

Such carriages can be used wherever machines for processing strip materials are required, e.g. in packaging machinery in machinery for coating strip materials and webs of all kinds, in printing machinery, in rerolling and slitting machinery, etc.

BACKGROUND OF THE INVENTION

An unrolling carriage for strip material generally comprises a pair of support plates connected by a plurality of traverse bars or rods and has two swingable arms which can be displaced toward and away from one another along the traverses by threaded spindles to allow a roll to be engaged or disengaged by the members carried by these arms. At least one of the swingable arms can be provided with a drive for the respective roll-engaging member, thereby controlling rotation of the roll for windup or delivery of the strip material.

An unwinding carriage of this type allows the arms to accommodate rolls of different width and different diameters. The roll drive must be so dimensioned that it can remain in control even in the case of heavy rolls or coils. This means that the system must have comparatively heavy drive motors, which are usually constituted as motor-generator units so that they can positively drive the roll or brake rotation thereof selectively.

In the past, the drive motor has been mounted directly on a respective swingable arm and is usually located so that it lies within the working width of the carriage. This means that within the working width, space must be reserved for the working motor and this, of course, diminishes the working width. In addition, the heavy motor must be raised and lowered with the arms.

OBJECTS OF THE INVENTION

It is, therefore, the principal object of our present invention to provide a construction of a roll carriage which is as compact as is possible and which utilizes the full spacing between the support plates as the working width of the carriage, i.e. the width within which a roll can be accommodated.

Another object of this invention is to overcome the drawbacks of earlier roll carriages and thereby increase the working width thereof.

Still another object of the invention is to relieve the arms and arm-support system of a roll carriage from the weight of high-powered drive motors and the like and thereby reduce twist, distortion and wear of a roll carriage.

SUMMARY OF THE INVENTION

These objects and others which will become apparent hereinafter are attained, in accordance with the present invention in a system of the type described which is characterized by the following features:

(a) one of the traverse bars is formed with a central traverse bar of round cross section, i.e. circular cross section, defining a pivot axis extending parallel to the axis of the roll and transversely to the direction in which the strip material is fed;

(b) a central tube or elongated sleeve is rotatably mounted on the round traverse bar concentrically therewith so as to be angularly displaceable about the aforementioned axis and is affixed to swingable plates likewise displaceable about this axis and lying in planes perpendicular thereto, the swingable plates being displaceable about a positioning drive, e.g. a fluid-operated cylinder;

(c) the swingable arms are axially shiftable on the central tube via guide bushings or sleeves;

(d) the swingable plates are connected by a bracing or supporting traverse against which the swingable arms bear so that the supporting torque is taken up by this other traverse bar;

(e) at least within one of the swingable plates and one of the swingable arms, a drive shaft, which can also be referred to as a back shaft, is rotatably journaled to drive, within this swingable arm, a drive wheel operatively connected to the respective clamping member adapted to grip the roll; and (f) one of the support plates is additionally provided with an arcuate slot through which this shaft passes freely.

More specifically, a roll carriage for winding up and delivering strip material can comprise:

a pair of transversely spaced substantially vertical support plates;

traverse means spanned between the support plates and forming a rigid support therewith, the traverse means including a plurality of spaced-apart mutually parallel traverse bars, one of the traverse bars being a central traverse of round cross section defining an axis;

a central tube coaxial with the central traverse and angularly displaceable on the central traverse about the axis;

a pair of swingable plates fixed to the central tube and axially spaced apart therealong;

actuating means connected to the support and to at least one of the swingable plates for angularly displacing the swingable plates and the central tube about the axis:

a pair of arms provided with respective guide sleeves mounted on the central tube for angular displacement therewith about the axis and axially shiftable along the central tube toward and away from one another, another of the traverse bars being engaged by the arms to take up torque of arm weight and weight of a roll of strip material supported by the arms, the arms being provided with roll-engaging members adapted to grip a roll of the strip material between them;

a drive shaft journaled in at least one of the swingable plates and in the arms;

a drive wheel on the drive shaft in one of the arms operatively connected with the roll-engaging member of the one of the arms for driving a roll gripped by the members upon rotation of the shaft, at least one of the support plates having an arcuate slot traversed by an end of the shaft passing freely through the slot;

a drive motor mounted on the support and operatively connected to the end of the shaft for rotating same; and a threaded spindle extending parallel to the shaft and the axis and operatively connected to the arms for displacing the arms toward and away from one another to grip the roll between the members.

The invention thus differs from the state of the art at least in part by the provision of the aforedescribed drive shaft or back shaft. The latter passes through the support plate or through both of the support plates, extending freely through the arcuate slots therein. Consequently, the drive motor for this shaft can lie outside the support plates and thus outside the working width of the machine.

The swingable arms can be shiftable on the central tube over the total working width of the apparatus and the drive wheels which are keyed to the shaft can likewise be axially shiftable therealong. For this purpose the shaft can be constituted as a splined shaft.

The swingable arms can be tilted over a wide range since the central tube traverse does not limit the angular displacement. As a consequence, the usable working width between the roll-engaging members of the arms can be held to a maximum.

The motor can be fixed on one of the support plates so that the large weight of the motor is reliably taken up and does not have to move with the arms. This is important since the round traverse does not have to be of excessive length. Because the round traverse and the other round forming or supporting members need not be of excessive length and can be comparatively shorter than in earlier constructions so that the respective bending moments can be minimized, overall dimensioning of the apparatus can be reduced.

A fixed mounting of the drive motor externally of the support plates ensures that the drive pinion of this motor and the drive gear meshing with this pinion and mounted upon the shaft can both be external of the space between the support plates. The drive pinion can be coaxial with the round traverse bar and, consequently, as the swingable plates and the arm assembly carrying the shaft is angularly displaced about the axis of this traverse bar, the drive gear can roll on the drive pinion to maintain the coupling between them.

As a consequence, high power and heavy drive motors can be mounted directly on one or both of the support plates and need not be carried by the swingable plates or the arm assembly.

An especially reliable coupling between the shaft and the drive wheel for the roll-gripping members can be obtained by forming the drive shaft as a spline shaft and enabling the drive wheel to be axially shiftable on this spline shaft while being angularly coupled or keyed thereto.

The drive for the arm-positioning spindle can also be provided externally of the space between the mounting plates. In this case, a threaded spindle for the swingable arms can be journaled in the swingable plates and the journal at least at one end of this spindle can pass through the arcuate slot in the respective support plate so that it can be coupled, externally thereof with a spindle drive motor.

The spindle drive motor can be a hydraulic motor since hydraulic motors are capable of delivering the high torque required for operating the spindle. However, since the hydraulic motor is of comparatively light weight, it can be swingable with the swingable or displaceable plates and it is not necessary to mount this motor on a fixed support or bracket.

Both the back shaft and the arm-adjusting spindle can be journaled at opposite ends. However, it is also advantageous to provide the central tube with an intermediate plate substantially midway between its ends which can provide a journal for the back shaft and the arm-positioning spindle.

By extending the shaft to and through the opposite support plates, the torque can be transferred through appropriate drives in both swingable arms to both sides of the roll core. In addition, a second motor generator can be mounted on the opposite support plate and also coupled to the shaft by gears in the manner described so that especially high torques can be applied to the shaft.

The arm-positioning spindle can also extend to and through the opposite support plate which, for this purpose, is likewise provided with an arcuate slot. The spindle can then have threaded portions of opposite hand or pitch on opposite sides of the intermediate plate.

Especially when the apparatus is to be used in so called clean-room conditions, e.g. for handing strip materials like magnetic tape, it is advantageous to provide a cove for the arm-positioning spindle. This cover can be mounted in recesses in the swingable plates and the swingable arms can have slit like cut outs accommodating the cover, hood or shield.

A further feature of the invention, also of particular value for clean room operations, comprises bellows-sleeve sheaths which can surround the portions of the shaft which might otherwise be exposed between the plates and between the plates and arms.

According to another feature of the invention, a load bearing system is provided for the swingable arms by forming each of the swingable arms in a region remote from the free end carrying the roll, with a guide fork which engages another of the traverse bars forming a supporting traverse, the support traverse being preferably a bar of polygonal cross section spanned between the swingable plates and forming with the latter a rigid structure. To allow automatic adjustment of the guide, at least one of the fork shanks can be provided with a channel of cylindrical segmental configuration whose axis is parallel to the axis of the polygonal bar and which receives a cylindrically segmental shoe forming a guide surface the shoe rocking in the channel. The guide surface between the shoe and the bar can be provided with roller elements. This enables shifting of the arms along the bar with high precision and force transmission between the arms and the bar to take up the load of the roll even where extremely heavy rolls are to be handled.

To allow the carriage to be used with high versatility of applications, especially where drop or faller rollers, adhesive tables and the like are to be employed, the connecting traverses between the support plates can receive removable and replaceable auxiliary plates for web guide elements of any selected type.

The swingable arms can be jointly displaced, in addition, transversely to the direction in which the web is displaced by mounting the threaded spindle so that it and its bearings are axially shiftable. A positioning cylinder for axial shifting of the threaded spindle is then provided and can be mounted on the bearing assembly for the spindle at one of the swingable plates. This arrangement is advantageous when the web from a new roll is to be spliced to the web of a previous roll for edge alignment of the web.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
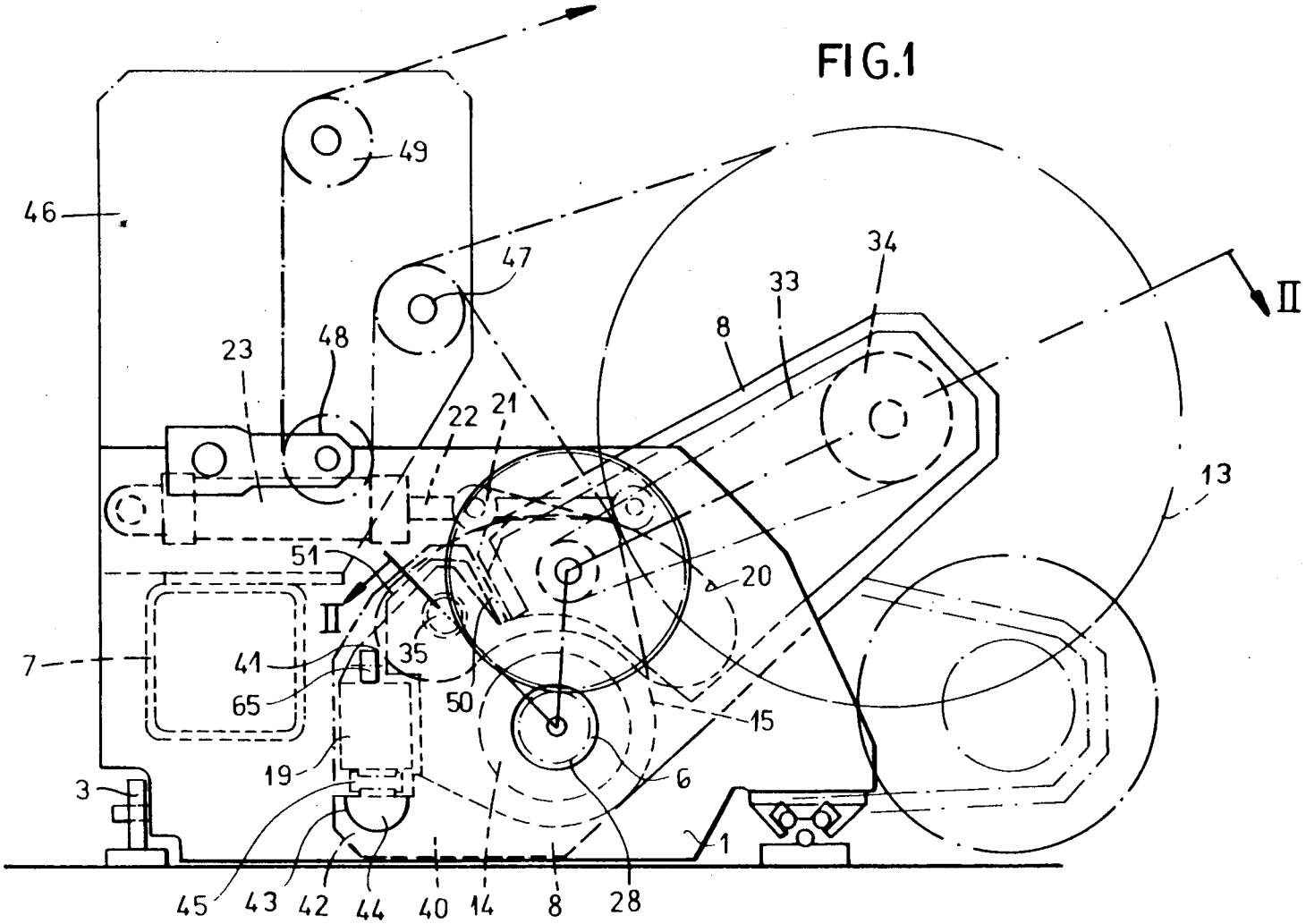
FIG. 1 is a side elevational view of a roll handling carriage according to the invention.

The roll carriage of the invention comprises two support plates 1, 2 which can be formed with wheels 3 and/or guides 4, enabling the carriage to be shifted on rails 5 transverse to the direction of movement of the respective web or strip material. The rails 5 do not extend over the entire width of the machine and serve only to provide a limited transverse shiftability of the carriage since the transverse shiftability is required only to adjust the position of the edge of the strip while it is running off from the roll or coil.

The support plates 1 and 2 of the carriage are rigidly interconnected by transverse bars 6 and 7 so that the carriage has a torsionally stiff construction. Additional transverse bars or struts can be provided as required for this purpose.

The transverse bar 6 is of round (circular) cross section and serves as the central supporting element for swingable arms 8 and 9.

Figure 2:
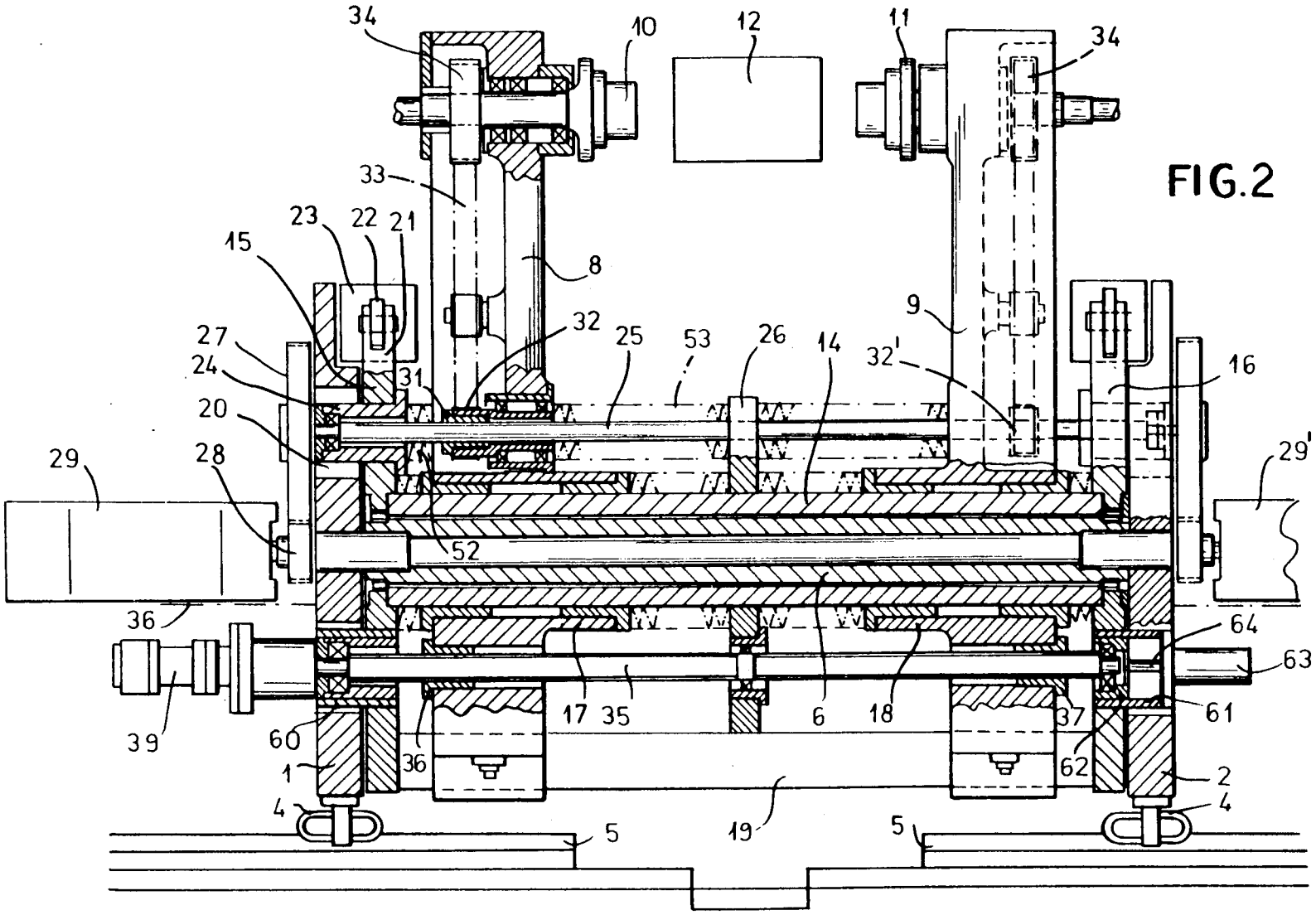
FIG. 2 is a cross sectional view of highly diagrammatic form and with portions of the structure behind other parts in the illustration of FIG. 1, being swung into the drawing plane in FIG. 2 so that FIG. 2 corresponds substantially to a section along the line II—II of FIG. 1.

The swingable arms 8 and 9 carry drivable clamping members or chucks 10 and 11 which can engage a core 12 of a roll 13. The core 12 has been shoWn only diagrammatically in FIG. 2. The transverse dimension of the core in the direction of the core axis has likewise been illustrated only diagrammatically.

The round transverse bar 6 is fixed to the support plates 1 and 2 and thus is not movable relative to the nonswingable parts of the roll carriage.

On the transverse bar 6 a central tube, sleeve or hollow member 14 is rotatable, i.e. angularly displaceable, this tube being coaxial with the transverse bar 6 and having a horizontal axis in common therewith.

A pair of lateral swingable plates 15 and 16 and a central intermediate swingable plate 26 are rigidly screwed to the central tube 14 so that these plates and the central tube form a unit which is angularly displaceable about the aforementioned axis.

A pair of guide sleeves 17 and 18 are axially displaceable on the central tube 14. Each of these guide sleeves 17 and 18 is formed with a swingable arm 8 and 9, respectively.

The swingable plates 15 and 16 are not only connected together by the central tube 14, but are also rigidly joined by a bracing traverse 19 spaced from the central tube 14 so that the assembly 14 through 16 and 19 forms a torsionally stiff rigid frame which is swingable on the round traverse 6.

Since the swingable plates 15 and 16 and the swingable arms 8 and 9 are jointly angularly displaceable about the round traverse 6, the swingable arms can be lowered to the floor of the plant as shown in dot-dash lines in FIG. 1 for roll changing, since this swinging movement is not restricted by further traverse bars.

The support plates 1 and 2 are each formed with an arcuate slot 20 concentric to the axis of the round traverse bar 6 and which, as will be apparent hereinafter, allows the drive shaft for rotating the roll grippers as well as the threaded spindle to pass through the support plates and be driven externally of the space between them.

The swingable plates 15 and 16 can be substantially sector shaped and can engage with respective forks 21 the piston rods 22 of respective positioning cylinders 23 which can be anchored on the support plates. In practice, only one such cylinder 23 may be required and can be pivotally connected to the support plate 1 so that its piston rod 22 is articulated to the fork 21 of the swingable plate 15.

Within the swingable plate 15 a journal sleeve or bushing 24 is provided for a back shaft 25. The back shaft 25 is formed as a key or spline shaft. Intermediate along its length, the back shaft, 25 can be journaled in the intermediate plate. The journal bushing 24 extends through the slot 20 and, on a formation at an end of the shaft 25 projecting from the bushing 24 and externally of the space between the support plates 1 and 2, a driven gear 27 can be keyed to the shaft.

The driven gear 27 meshes with a central gear 28 centered on the axis of the round traverse 6 and driven by a drive motor 29. The drive motor 29 can include a transmission unit, i.e. speed-reducing and torque-increasing gearing.

The drive motor 29 is mounted by a bracket shown schematically at 30 on the support plate 1. Since the central gear or pinion 28 is coaxial to the round traverse bar 6 and the central tube 14 is likewise coaxial therewith, upon angular displacement of the swingable plates 15 and 16, the shaft 25 is angularly displaced with the same center and the driven gear 27 will roll about the central gear 28 while remaining in mesh therewith.

The shaft 25 passes through openings in the swingable arms 8 and 9. An entrainer 31 can engage the shaft 25 for each of two drive wheels 32 and 32' in the respective arms 8 and 9. The entrainers 31 engage in the key grooves or splines of the shaft 25 so that each entrainer 31 can be movable together with the respective swingable arm 8 or 9 in the axial direction on the shaft 25.

The drive wheels 32 are connected by drive belts 33 with the driven wheels 34 for the roll-engaging chuck members 10 and 11. The belt may be a cog belt where high driving power must be transmitted.

Where a particularly high roll torque is required, a drive motor 29' can be mounted on the support plate 2 and can be coupled to the shaft 25 in a similar manner. The drive motors 29 and 29' are preferably formed as motor-generator units which can act both as drives and as brakes. Hydraulic motors can also be used, although in this case two brake devices are required.

In addition, an arm-positioning spindle 35 is journaled in the adjustable plates 15 and 16 as well as in the intermediate plate 26, but can also be axially displaceable therein. The two sides of this spindle separated by the intermediate plate 26, have screwthreads of opposite hand or pinch, so that upon rotation of the spindle in one direction, the arms will be moved in opposite directions, i.e. toward and away from one another.

The arm-position spindle 35 is journaled in a journal bushing 38 which is axially shiftable in a guide bushing 60 of the swingable plate 15 and extends through the arcuate slot 20. On a flange of the journal bushing 38, a hydraulic motor 39 is mounted and serves to drive the arm positioning spindle 35. This hydraulic motor 39 is capable of providing the spindle with the high torque required for an accurate positioning of the swingable arms 8 and 9.

The opposite end of the threaded spindle 35 is journaled in a bearing bush 62 which is axially shiftable in a guide bushing 61 held in the swingable plate 16. A positioning cylinder 63 is mounted on the guide bushing 61 and has its piston rod 64 connected with the bearing bushing 62. This cylinder is capable of shifting the threaded spindle as a whole in the axial direction as is required for splicing of the strip materials.

Each swingable arm 8 and 9 is braced by the respective guide sleeves 17 and 18 on the central tube 14. However, the torque applied by the load on the arm is taken up by the bracing traverse 19 which may have a square or rectangular cross section.

The swingable arms 8 and 9 have guide forks 40 which straddle the bar 19.

More specifically, the guide forks 40 have two fork shanks 41 and 42. The greater part of the torque must be transferred by the fork shank 42. As a consequence, this fork shank is provided with a channel 43 of cylinder segment shape with an axis parallel to the axis of the bar 19.

A circular segmental shoe 44 is received in and can rock within the channel 43 about the axis of the latter to compensate for irregularities in the guide and bracing traverse 19.

The force transmission to the running surface of the bracing traverse 19 is effected by a roller bearing 45. The guide for the fork shank 41 is somewhat simpler and can be provided by a roller 65 since here only small moments are absorbed.

On the support plates 1 and 2 and/or the traverse bars connecting same, accessory or mounting plates 46 can be fitted and can be spanned by deflecting rollers 47, 48 and 49. If desired within the mounting plates loop-forming compensation rollers or other processing means for the web can be provided. The basic carriage, therefore, provided with different mounting plates with various working elements can be used in a variety of systems. The basic carriage structure, therefore, can remain the same and need not be altered in construction for the particular use.

The arm positioning spindle 35 is covered by a sheath, shield or cover 51 which projects into a slit 50 in the swingable plates 15 and 16. With such a cover of the spindle 35 and bracing traverse 19, dust particles can be held back to maintain clean room conditions where necessary. Dust-tight covers in the form of bellows-sleeves 52 and 53 are provided on the shaft 25 between the arms and the plates.

The overall construction of the carriage thus combines a twist free torsion stiff basic frame formed by the support plates 1 and 2 with a round traverse 6 forming the central axis for all swinging parts carrying the roll or coil of strip material.

On this round traverse is the central tube 14 which together with the swingable plates 15 and 16, the bracing traverse 19 and the swingable arms 8 and 9 forms another torsion stiff unit. The arrangement of the shaft 25 with its drive allows a fixed positioning of the drive motor 29 or 29' coaxial with the round traverse. This ensures free swingability of the arms 8 and 9 to the floor of the plant and guarantees that the space between the swingable plates is completely free from the drive motor. This, of course, maximizes the effective working width between the plates and the traverse. The swingable arms 8 and 9 are completely free from the load of the motors.

We claim:

1. A roll-unwinding carriage for strip material, comprising:

a pair of transversely spaced substantially vertical support plates;

traverse means spanned between said support plates and forming a rigid support therewith, said traverse means including a plurality of spaced-apart mutually parallel traverse bars, one of said traverse bars being a central traverse of round cross section defining an axis;

a central tube coaxial with said central traverse and angularly displaceable on said central traverse about said axis;

a pair of swingable plates fixed to said central tube and axially spaced apart therealong;

actuating means connected to at least one of said swingable plates for angularly displacing said swingable plates and said central tube about said axis;

a pair of arms provided with respective guide sleeves mounted on said central tube for angular displacement therewith about said axis and axially shiftable along said central tube toward and away from one another, another of said traverse bars being engaged by said arms to take up torque of arm weight and weight of a roll of strip material supported by said arms, said arms being provided with roll-engaging members adapted to grip a roll of said strip material between them;

a drive shaft journaled in at least one of said swingable plates and in said arms;

a drive wheel on said drive shaft in one of said arms operatively connected with the roll-engaging member of said one of said arms for driving a roll gripped by said members upon rotation of said shaft, at least one of said support plates having an arcuate slot traversed by an end of said shaft passing freely through said slot;

a drive motor mounted on said support and operatively connected to said end of said shaft for rotating same; and a threaded spindle extending parallel to said shaft and said axis and operatively connected to said arms for displacing said arms toward and away from one another to grip said roll between said members.

2. The roll-unwinding carriage defined in claim 1, further comprising:

a drive pinion disposed along an outer side of said one of said support plates, coaxial with said central traverse and rotatable about said axis, said dive pinion being coupled with said drive motor;

means for mounting said drive motor on said one of said support plates; and a driven gear meshing continuously with said drive pinion and mounted on said end of said shaft.

3. The roll-unwinding carriage defined in claim 2 wherein said drive motor is a motor-generator capable of acting as a brake for said roll.

4. The roll-unwinding carriage defined in claim 2 wherein a respective drive motor is mounted on each of said support plates, each of said drive motors being provided with a respective drive pinion meshing with a driven gear mounted on a respective end of said shaft, each end of said shaft passing freely through an arcuate slot formed in the respective support plate.

5. The roll-unwinding carriage defined in claim 4 wherein each of said slots is centered on said axis.

6. The roll-unwinding carriage defined in claim 1 wherein said shaft is a splined shaft and said drive wheel is angularly engaged by and axially shiftable along said splined shaft.

7. The roll-unwinding carriage defined in claim 1 wherein said threaded spindle is journaled in said swingable plates and also has an end passing through said slot and connected to a drive motor for rotating said spindle.

8. The roll-unwinding carriage defined in claim 7, further comprising an intermediate plate mounted on said central tube at a location between opposite ends thereof, said shaft and said spindle being journaled in said intermediate plate.

9. The roll-unwinding carriage defined in claim 7, further comprising a cover for said spindle received in slits formed in said swingable plates.

10. The roll-unwinding carriage defined in claim 1 wherein said shaft has segments between said swingable plates and said arms, said segments being covered with bellows sleeves.

11. The roll-unwinding carriage defined in claim 1 wherein each of said arms is formed with a guide fork straddling said other traverse bar and provided with guides braced against said other traverse bar.

12. The roll-unwinding carriage defined in claim 11 wherein each of said forks has a fork shank formed with a cylindrical segmental recess receiving a cylindrical segmental shoe adapted to rock in said recess and braced against said other traverse bar and having an axis parallel thereto.

13. The roll-unWinding carriage defined in claim 1 wherein said support plates are provided with mounting plates carrying guide elements for said strip material.

14. The roll-unwinding carriage defined in claim 1 wherein said threaded spindle is axially shiftable relative to said support plates, said carriage further comprising a fluid-pressure cylinder connected to said spindle for axially shifting same.

15. The roll-unwinding carriage defined in claim 1, further comprising means mounting said support plates for limited displacement parallel to said axis for alignment of edges of strip material of said roll with strip material previously unrolled for splicing.

* * * * *